US007970303B2

(12) United States Patent
Yamada

(10) Patent No.: US 7,970,303 B2
(45) Date of Patent: Jun. 28, 2011

(54) IMAGE FORMING APPARATUS

(75) Inventor: Taichi Yamada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 173 days.

(21) Appl. No.: 12/511,555

(22) Filed: Jul. 29, 2009

(65) Prior Publication Data

US 2010/0178070 A1 Jul. 15, 2010

(30) Foreign Application Priority Data

Jan. 13, 2009 (JP) ..... 2009-004784

(51) Int. Cl.
*G03G 15/02* (2006.01)
*G03G 15/00* (2006.01)

(52) U.S. Cl. ..... 399/50; 399/44

(58) Field of Classification Search ..... 399/50, 399/71, 44, 346, 174, 176
See application file for complete search history.

(56) References Cited

U.S. PATENT DOCUMENTS 6,512,905 B1 * 1/2003 Tomiki et al. ..... 399/50
7,095,969 B2 * 8/2006 Imura ..... 399/44
7,505,728 B2 * 3/2009 Yamaguchi et al. ..... 399/346
7,634,206 B2 * 12/2009 Hagiwara et al. ..... 399/44
2006/0133872 A1 * 6/2006 Sugiura et al. ..... 399/346

FOREIGN PATENT DOCUMENTS

JP A-7-244419 9/1995
JP A-9-101655 4/1997
JP A-10-221931 8/1998
JP 2008276083 A * 11/2008

* cited by examiner

*Primary Examiner* — Susan S Lee
(74) *Attorney, Agent, or Firm* — Oliff & Berridge, PLC

(57) ABSTRACT

An image forming apparatus includes: an image bearing body on which surface a solid lubricant is supplied, forming and bearing an image on the surface; a charging member to which a voltage is applied, being in contact with the image bearing body to impart a charge; a voltage applying section that applies the voltage to the charging member, capable of switching the voltage between superimposed voltage on which DC voltage and AC voltage are superimposed and non-superimposed voltage including only DC voltage; an image forming section that forms a toner image; a transfer device that transfers the formed toner image to a transferring body; a cleaning member that contacts the image bearing body to scrape unnecessary substance from the surface; and a voltage switching section that switches the voltage applied to the charging member between the superimposed voltage and the non-superimposed voltage according to an amount of the solid lubricant.

17 Claims, 7 Drawing Sheets

IMAGE FORMING APPARATUS

CROSS-REFERENCE TO RELATED APPLICATION

This application is based on and claims priority under 35 USC 119 from Japanese Patent Application No. 2009-004784 filed on Jan. 13, 2009.

BACKGROUND (i) Technical Field

The present invention relates to an image forming apparatus.

(ii) Related Art

There is a type of image forming apparatus that includes a charging device in order to charge a photoreceptor layer on a surface of a photoreceptor. The charging device applies a DC voltage on which an AC voltage is superimposed to the photoreceptor through a charging roller.

SUMMARY

According to an aspect of the invention, there is provided an image forming apparatus that includes:

an image bearing body on which surface a solid lubricant is supplied, the image bearing body forming an image and bearing the image on the surface;

a charging member to which a voltage is applied, the charging member being in contact with the image bearing body to impart a charge to the image bearing body;

a voltage applying section that applies the voltage to the charging member, the voltage applying section being able to switch the voltage between a superimposed voltage on which a DC voltage and an AC voltage are superimposed and a non-superimposed voltage including only the DC voltage;

an image forming section that forms a toner image on the surface of the image bearing body charged by the charging member;

a transfer device that transfers the toner image formed on the surface of the image bearing body to a transferring body;

a cleaning member that comes into contact with the surface of the image bearing body to scrape an unnecessary substance from the surface after the toner image is transferred to the transferring body; and a voltage switching section that switches the voltage to be applied to the charging member by the voltage applying section between the superimposed voltage and the non-superimposed voltage according to an amount of the solid lubricant on the image bearing body.

BRIEF DESCRIPTION OF THE DRAWINGS

Exemplary embodiments of the present invention will be described in detail based on the following figures, wherein.

DETAILED DESCRIPTION

Figure 1:
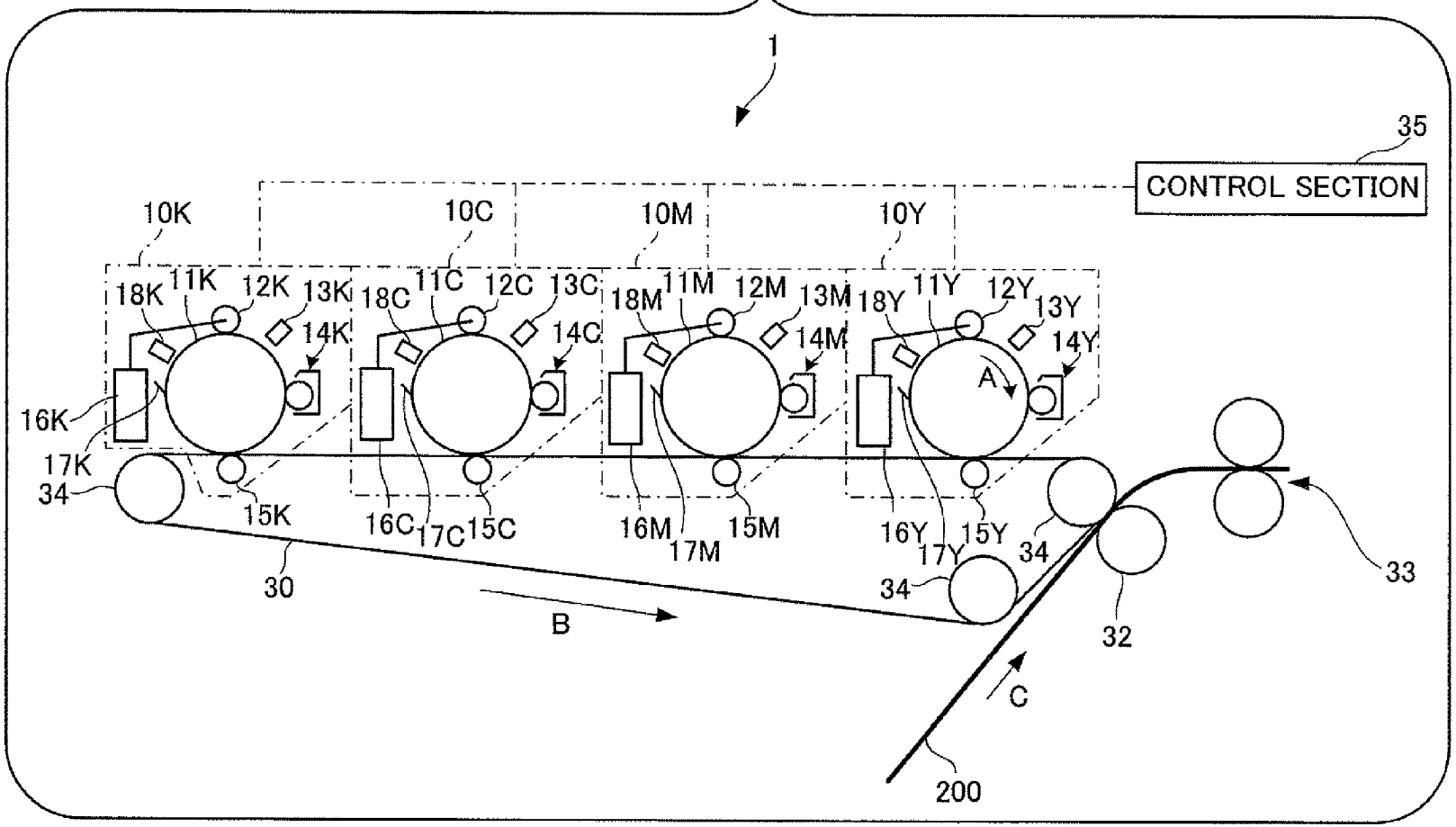
FIG. 1 is a schematic diagram illustrating a structure of a main part of a printer that is of an image forming apparatus according to a first exemplary embodiment.

FIG. 1 is a schematic diagram illustrating a structure of a main part of a printer that is of an image forming apparatus according to a first exemplary embodiment of the invention.

Referring to FIG. 1, a printer 1 includes four image forming sections 10Y, 10M, 10C, and 10K. The image forming sections include photoreceptor rollers 11Y, 11M, 11C, and 11K, charging rollers 12Y, 12M, 12C, 12K, exposure sections 13Y, 13M, 13C, and 13K, development sections 14Y, 14M, 14C, and 14K, primary transfer rollers 15Y, 15M, 15C, and 15K, charging control devices 16Y, 16M, 16C, and 16K, cleaning members 17Y, 17M, 17C, and 17K, and erase lamps 18Y, 18M, 18C, and 18K. The printer 1 can perform full-color printing, and letters Y, M, C, and K appended to the components designate yellow, magenta, cyan, and black image forming components.

The printer 1 also includes an intermediate transfer belt 30, a secondary transfer roller 32, a fixing device 33, a tension roller 34, and a control section 35.

A color image forming operation of the printer 1 will be described.

First, the yellow image forming section 10Y starts toner image formation. After the erase lamp 18Y removes electricity on a surface of the photoreceptor roller 11Y rotated in a direction of an arrow A, the charging roller 12Y that is rotated while brought into contact with the photoreceptor roller 11Y imparts a predetermined charge to the photoreceptor roller 11Y. The charging control device 16Y applies a voltage (hereinafter referred to as superimposed voltage) in which an AC voltage is superimposed on a predetermined DC voltage to the charging roller 12Y.

Then the exposure section 13Y irradiates the surface of the photoreceptor roller 11Y with exposure light corresponding to a yellow image to form a latent image. The development section 14Y develops the latent image with a yellow developer to form a yellow development image on the photoreceptor roller 11Y. The primary transfer roller 15Y transfers the yellow development image onto the intermediate transfer belt 30 to form a transfer image. The intermediate transfer belt 30 is circularly moved in a direction of an arrow B, and the magenta image forming section 10M forms a toner image such that a magenta development image reaches the primary transfer roller 15M at the time when the yellow transfer image transferred onto the intermediate transfer belt 30 reaches the primary transfer roller 15M of the magenta image forming section 10M located on the downstream side in the moving direction of the intermediate transfer belt 30. The primary transfer roller 15M transfers the magenta development image onto the yellow transfer image on the intermediate transfer belt 30, and the magenta development image is superimposed on the yellow transfer image.

Then the cyan and black image forming sections 10C and 10K sequentially form development images at the similar timing, and the primary transfer rollers 15C and 15K sequentially transfer the development images onto the yellow and magenta transfer images on the intermediate transfer belt 30, and the cyan and black development images are superimposed on the yellow and magenta transfer images.

The secondary transfer roller 32 performs secondary transfer of the multi-color transfer image that is transferred onto the intermediate transfer belt 30, to a sheet 200. The sheet 200 to which the multi-color transfer image is transferred is conveyed in a direction of an arrow C, and the fixing device 33 fixes the multi-color transfer image onto the sheet 200 to form a color image.

Figure 2:
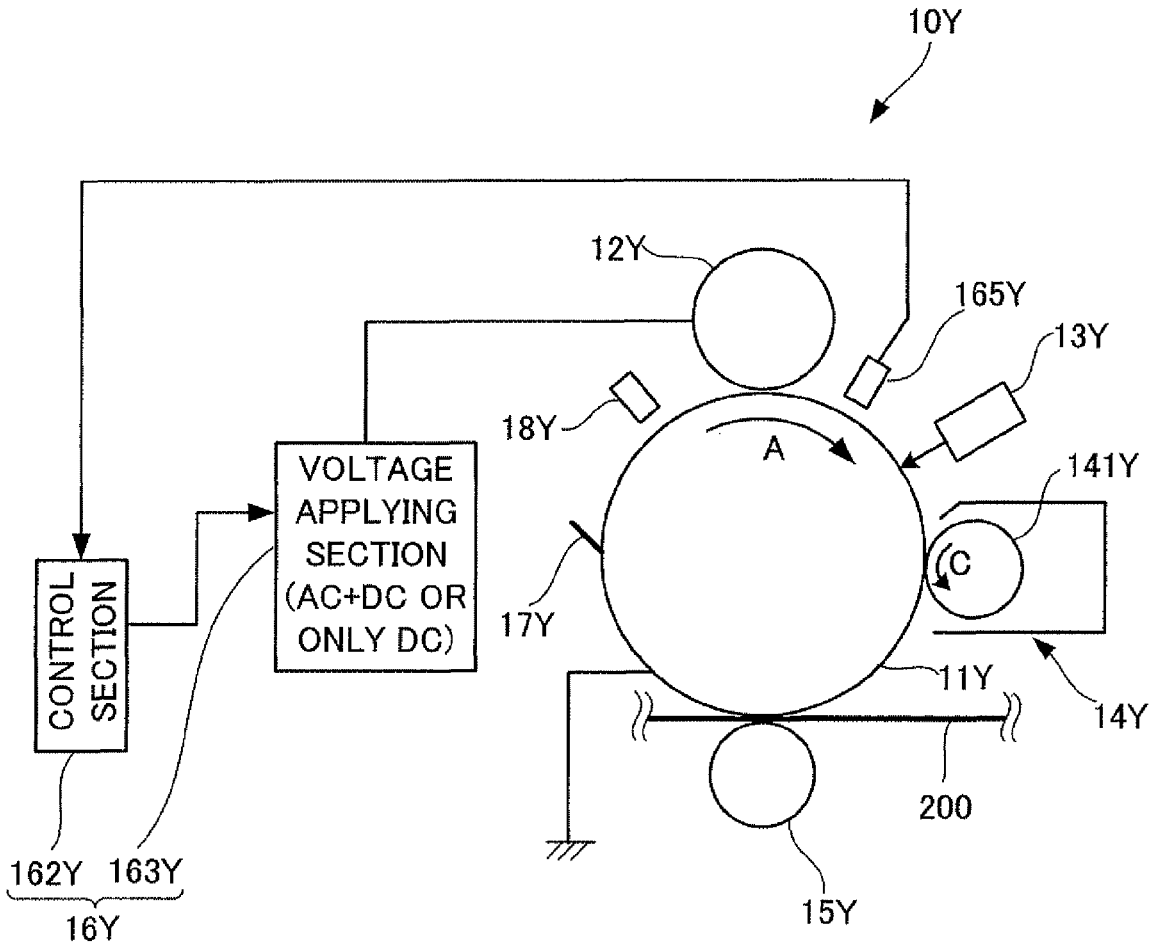
FIG. 2 is a schematic diagram illustrating a structure of a yellow image forming section.

FIG. 2 is a schematic diagram illustrating a structure of the yellow image forming section. Because other image forming sections except for the yellow image forming section have the same structure and function as those of FIG. 2, the yellow image forming section 10Y will typically be described below.

FIG. 2 illustrates each section constituting the image forming section 10Y. The development section 14Y includes a development roller 141Y to which a development bias is applied and a housing in which the developer is stored. The developer includes toner and a magnetic carrier, and metallic soap (for example, zinc stearate) that is a kind of solid lubricant adheres to the toner. The magnetic carrier is a magnetic particle that charges the toner by friction with the toner. The charged toner adheres electrostatically to the magnetic carrier. Although not illustrated, the development roller 141Y includes a cylindrical sleeve and a magnet roller. The cylindrical sleeve is rotated in the direction of the arrow C. The magnet roller is fixed inside the sleeve while being independent of the sleeve, and plural magnets are arranged in the magnet roller in the sleeve revolving direction. The developer stored in the housing is adsorbed onto a sleeve surface by a magnetic force generated from the magnet roller disposed inside the sleeve. An AC voltage and a development bias are applied to the development roller 141Y while superimposed on each other, thereby generating an electric field between the development roller 141Y and a background portion of the electrostatic latent image on the photoreceptor roller 11Y. The electric field is orientated toward a direction in which the toner in the developer adsorbed to the development roller 141Y (sleeve surface) is prevented from adhering to the background portion of the electrostatic latent image. A potential difference between the development roller 141Y and a background portion of the electrostatic latent image is adjusted in order to suppress both the adhesion of the reversed-polarity toner to the background portion due to the excessively large potential difference and the adhesion of the low charged toner to the background portion due to the excessively small potential difference. On the other hand, in a development region formed between the development roller 141Y and the photoreceptor roller 11Y, the toner in the developer adsorbed onto the surface of the development roller 141Y is electrostatically attracted onto the electrostatic latent image side of the photoreceptor roller 11Y by an electric field generated between the development roller 141Y and the electrostatic latent image of the photoreceptor roller 11Y, thereby the toner adheres to the electrostatic latent image to form the toner image.

The primary transfer roller 15Y transfers the toner image on the photoreceptor roller 11Y onto the intermediate belt 200. The cleaning member 17Y removes the toner remaining on the photoreceptor roller 11Y, and the erase lamp 18Y removes the electricity of the photoreceptor roller 11Y. The cleaning member 17Y is an example of the cleaning member of the invention. The cleaning member 17Y made of rubber or resin comes into elastic contact with the surface of the photoreceptor roller 11Y, and the cleaning member 17Y can scrape the toner remaining on the photoreceptor roller 11Y without scratching the surface of the photoreceptor roller.

The detailed structure of the charging control device 16Y included in the yellow image forming section 10Y will be described below with reference to FIG. 2.

The charging control device 16Y includes a control section 162Y, a voltage applying section 163Y, and an environmental sensor 165Y. The control section 162Y and the environmental sensor 165Y constitute an example of the voltage switching section of the invention, and the voltage applying section 163Y corresponds to an example of the voltage applying section of the invention, the environmental sensor corresponds to an example of the environment sensing section as well as an example of the temperature and humidity sensing section, and the control section 162Y corresponds to an example of the environment response switching section of the invention as well as an example of the temperature and humidity response switching section of the invention.

Unless the photoreceptor roller 11Y is in a high-temperature and high-humidity environment, the control section 162Y directs the voltage applying section 163Y to apply the superimposed voltage (AC+DC) to the charging roller 12Y, thereby charging the photoreceptor roller 11Y. When the photoreceptor roller 11Y is charged by the superimposed voltage, charging uniformity is maintained in terms of both time and space.

For two reasons, that is, abrasion of the photoreceptor layer of the photoreceptor roller 11Y is prevented and cleaning performance is improved in a low-temperature and low-humidity environment, the printer 1 of the first exemplary embodiment employs a structure in which a protective film is formed on the surface of the photoreceptor roller 11Y using the metallic soap (for example, zinc stearate) included in the developer. Although the protective film is also formed by the metallic soap even if the metallic soap is applied to the photoreceptor roller surface using a brush, the structure with fewer components is employed in the first exemplary embodiment.

The metallic soap in the developer corresponds to an example of the solid lubricant of the invention. When the protective film is formed on the surface of the photoreceptor roller 11Y by the metallic soap, the toner is easily removed from the photoreceptor roller 11Y while the protective film protects the surface of the photoreceptor roller 11Y.

In the photoreceptor roller 11Y of the printer 1 of FIG. 1, because the image is formed after a direction of a sheet size is provided by an operation, an image forming region and a non-image forming region are generated within an image forming region used in the image formation with the maximum sheet size during the image formation with the directed sheet size. In the high-temperature and high-humidity environment in which the metallic soap easily adheres to the surface of the photoreceptor roller, a very large difference tends to be generated in the amount of metallic soap between the image forming region and the non-image forming region.

Therefore, in the printer 1 of the first exemplary embodiment, when the control section 162Y that controls the charging determines that temperature information and humidity information, supplied from the environmental sensor 165Y, indicate the predetermined high-temperature and high-humidity environment, the control section 162Y directs the voltage applying section 163Y to switch the voltage to be applied to the charging roller 12Y from the superimposed voltage to a voltage to be applied (hereinafter referred to as non-superimposed voltage) including only the DC voltage. The voltage switching action will be described with reference to FIGS. 3 and 4.

Figure 3A:
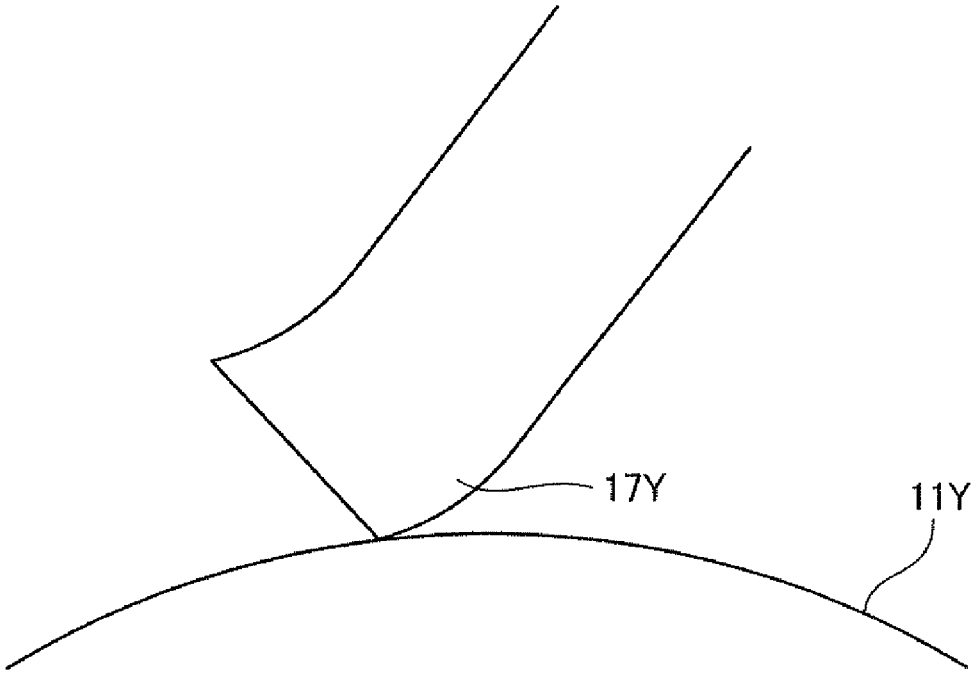
FIG. 3A illustrates a state of a metallic soap film formed on a photoreceptor layer on the surface of a photoreceptor roller 11Y and FIG. 3B illustrates a state of toner located on the metallic soap film.
Figure 3B:
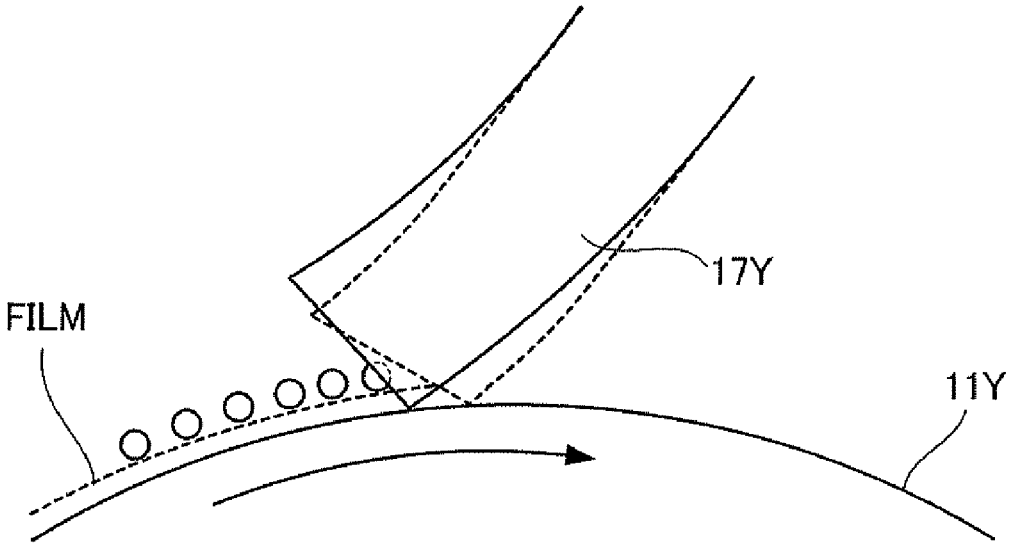

FIG. 3A illustrates a state of the metallic soap film formed on the photoreceptor layer on the surface of the photoreceptor roller 11Y and FIG. 3B illustrates a state of toner located on the metallic soap film. Parts (a), (b), (C), (d), and (e) of FIG. 4 are schematic diagrams explaining the voltage switching action.

As illustrated in part (a) of FIG. 3, the elastic cleaning member 17Y made of rubber or resin is in contact with the surface of the photoreceptor roller 11Y. The protective film is formed on the surface of the photoreceptor roller 11Y by the metallic soap in order to protect the photoreceptor roller 11Y. FIG. 3B illustrates a positional relationship between the cleaning member 17Y and the toner located on the protective film when the protective film is formed on the surface of the photoreceptor roller 11Y by the proper amount of metallic soap.

Figure 4:
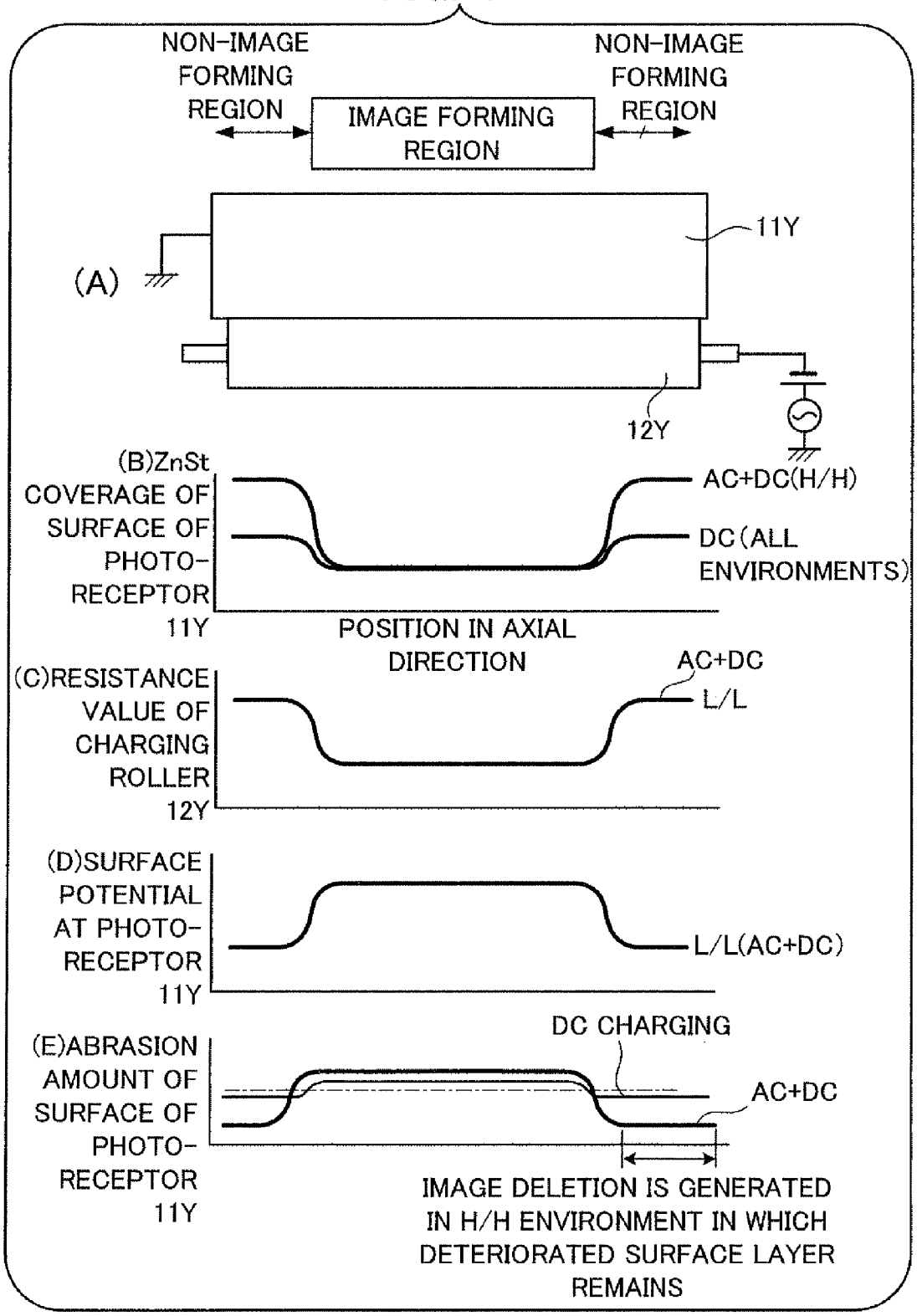
FIG. 4 is a schematic diagram that explains voltage switching action.

Part (a) of FIG. 4 illustrates the photoreceptor roller 11Y and the charging roller 12Y, and also illustrates the image forming region and non-image forming region on the photoreceptor roller 11Y in the present image formation (image formation with an image size that is smaller than the maximum image size). Part (b) of FIG. 4 illustrates a difference in the amount of metallic soap on the surface of the photoreceptor roller 11Y, that is, between the image forming region and non-image forming region on the photoreceptor layer in the high-temperature and high-humidity environment (hereinafter the environment is referred to as H/H environment) having a temperature of 28° C. or more and humidity of 85% or more. Part (c) of FIG. 4 illustrates a difference in resistance value in charging roller regions corresponding to the image forming region and non-image forming region on the photoreceptor layer when the H/H environment of part (b) of FIG. 4 is changed to the low-temperature and low-humidity environment (hereinafter referred to as L/L environment) having a temperature of 10° C. or less and humidity of 10% or less. Part (d) of FIG. 4 illustrates a difference in surface potential between the image forming region and non-image forming region on the photoreceptor layer when the H/H environment is changed to the L/L environment. Part (e) of FIG. 4 illustrates a difference in abrasion amount of the photoreceptor surface corresponding to a zinc stearate coverage rate in the image forming region and non-image forming region under the H/H environment of part (a) of FIG. 4.

As illustrated in FIG. 3A, the cleaning member 17Y is in contact with the surface of the photoreceptor roller 11Y. Therefore, when the cleaning member 17Y removes the toner remaining on the photoreceptor roller 11Y, the cleaning member 17Y removes both the protective film formed by the metallic soap and the toner on the protective film.

When the photoreceptor roller 11Y is put into the H/H environment while the superimposed voltage is applied to the photoreceptor roller 11Y, the metallic soap in the image forming region contains large amounts of heat and moisture to enhance an adhesion rate of the metallic soap to the photoreceptor roller. At this point, the cleaning member 17Y removes both the metallic soap film and the toner because the toner exists in the image forming region. On the other hand, the metallic soap is hardly removed because the toner does not exist in the non-image forming region, thereby a film thickness of the metallic soap is increased. Parts (b) and (e) of FIG. 4 illustrate a state in which the film thickness of the metallic soap is increased.

Part (b) of FIG. 4 illustrates the state in which the film thickness in the non-image forming region on the photoreceptor layer of the photoreceptor roller surface is formed thicker than that in the image forming region when the superimposed voltage (AC+DC) is applied in the H/H environment. When the photoreceptor roller 11Y is put into the H/H environment while the superimposed voltage (AC+DC) is applied, a very large difference in film thickness is generated between the image forming region and the non-image forming region.

Therefore, as illustrated in part (e) of FIG. 4, the very large difference in abrasion amount of the photoreceptor layer is generated after the cleaning. When the image is formed after the non-image forming region is changed to the image forming region due to the change of the image size, sometimes image deletion is generated in the image forming region that has been previously the non-image forming region.

When the environment around the photoreceptor roller is changed from the H/H environment of part (b) of FIG. 4 to the L/L environment, a difference in resistance value of the charging roller is generated between a region corresponding to the non-image forming region and a region corresponding to the image forming region in accordance with a difference in the thickness of the protective film as illustrated in part (c) of FIG. 4. The difference in resistance value generates a difference in surface potential of the photoreceptor roller 11Y as illustrated in part (d) of FIG. 4. When the H/H environment is changed to the L/L environment after the difference in resistance value is generated in the H/H environment, the image with increased image density is obtained in the image forming region that has been previously the non-image forming region.

Therefore, in the first exemplary embodiment, the non-superimposed voltage is applied to the charging roller 12Y without applying the superimposed voltage in the H/H environment.

That is, when the control section 162Y determines that detection result from the environmental sensor 165Y indicates the H/H environment, the control section 162Y directs the voltage applying section 163Y to switch the applied voltage from the superimposed voltage (AC+DC) to the non-superimposed voltage (DC), and the non-superimposed voltage (DC) is applied to the charging roller 12Y.

Parts (b) and (e) of FIG. 4 also illustrate the state in which the non-superimposed voltage (DC) is applied. As can be seen from these figures, when the non-superimposed voltage (DC) is applied, as compared with the application of the superimposed voltage (AC+DC), high uniformity of the film thickness is obtained between the image forming region and the non-image forming region both in the H/H environment and the L/L environment.

Accordingly, when the voltage applying section 163Y applies the non-superimposed voltage (DC) under the control of the control section 162Y, the film thickness is uniformed as illustrated in part (b) of FIG. 4, and the abrasion amount is uniformed in the image forming region and non-image forming region of the photoreceptor layer even in the H/H environment as indicated by a line of the non-superimposed voltage (DC) of part (e) of FIG. 4. As a result, the image deletion is avoided even if images having different sizes are continuously formed in the H/H environment.

When voltage to be applied is previously switched to the non-superimposed voltage in the H/H environment, because the thickness of the protective film is uniformed, the resistance value of the charging roller and the surface potential at the photoreceptor layer are uniformed even if the H/H environment is changed to the L/L environment as illustrated in parts (c) and (d) of FIG. 4. Accordingly, the high-density image is avoided in the image forming region that has been previously the non-image forming region as illustrated in parts (c) and (d) of FIG. 4.

An image forming apparatus according to a second exemplary embodiment will be described below.

A main difference between the image forming apparatus of the second exemplary embodiment and that of the first exemplary embodiment lies in control performed by the control section 162Y. Therefore, the following explanation will focus on the control performed by the control section 162Y.

In addition to the difference in resistance value caused by the thickness of the protective film as illustrated in part (c) of FIG. 4, generally the charging roller 12Y has a characteristic in that the resistance value is changed as the temperature and humidity environment is changed.

Therefore, in the second exemplary embodiment, the control section 162Y determines the environmental change by using the change in resistance value of the charging roller. That is, the control section 162Y senses the resistance of the charging roller 12Y, and determines that the photoreceptor roller 11Y is in the H/H environment when the resistance of the charging roller 12Y indicates a predetermined low resistance value, and the control section 162Y switches the voltage to be applied from the superimposed voltage to the non-superimposed voltage.

Figure 5:
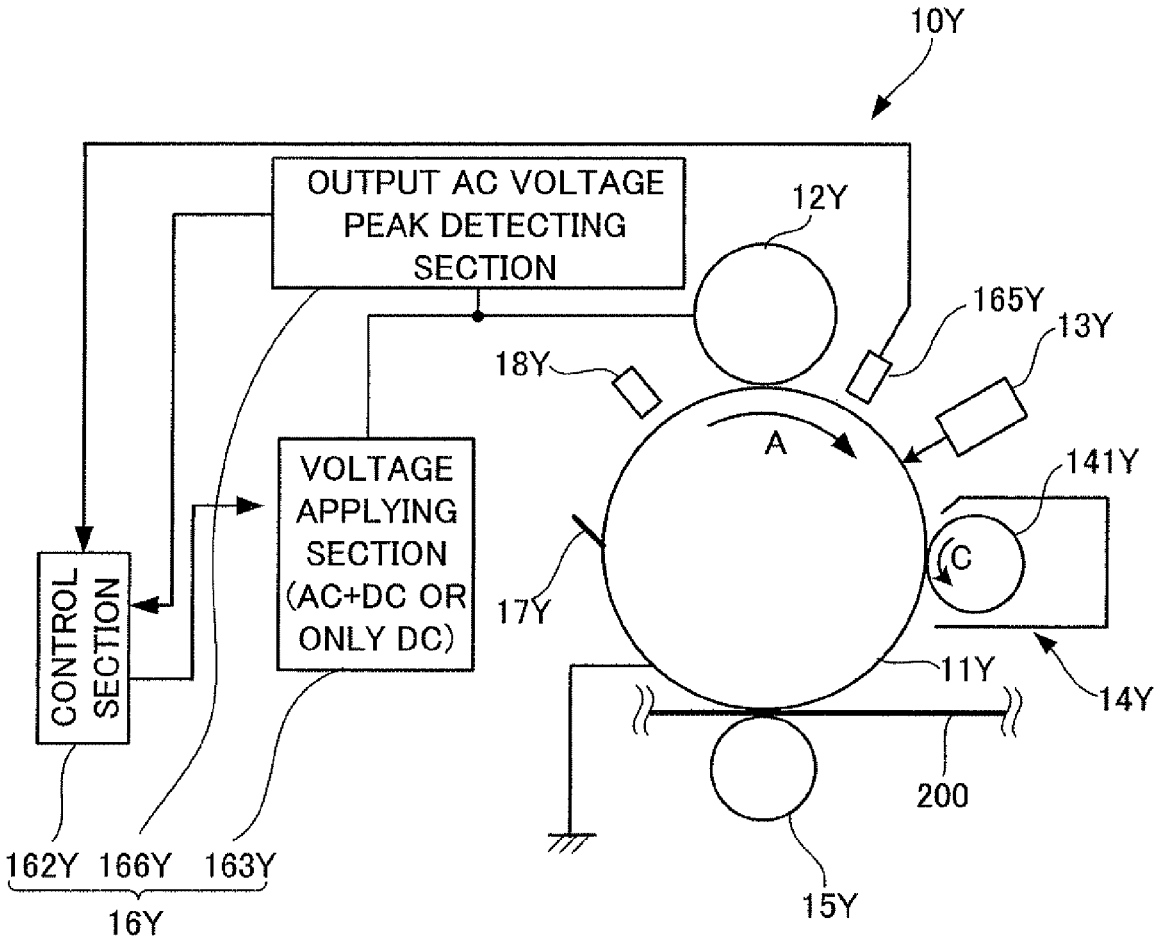
FIG. 5 illustrates a structure of the image forming section of a second exemplary embodiment in which an output AC voltage peak detecting section 166Y is added to the structure illustrated in FIG. 2.

FIG. 5 illustrates the second exemplary embodiment.

In the image forming section 10Y of the second exemplary embodiment of FIG. 5, an output AC voltage peak detecting section 166Y is added to the image forming section 10Y of the first exemplary embodiment of FIG. 2. A voltage applying section 163Y of the second exemplary embodiment supplies a constant current so as to keep an AC constant when the AC voltage is superimposed on the DC voltage.

In the structure of FIG. 5, the output AC voltage peak detecting section 166Y detects a voltage difference between a peak and a valley (peak-to-peak) in a sine wave of the AC voltage. When a voltage difference detected by the output AC voltage peak detecting section 166Y is equal to or lower than a predetermined value, the control section 162Y determines that the photoreceptor roller 11Y is put into the H/H environment, and switches the voltage to be applied from the superimposed voltage to the non-superimposed voltage. In the second exemplary embodiment, the output AC voltage peak detecting section corresponds to an example of the environment sensing section of the invention. The voltage to be applied and current characteristic of the DC component or the DC voltage to be applied and the surface potential at the photoreceptor may be detected to perform the control instead of the peak value of the AC voltage.

Finally, an image forming apparatus according to a third exemplary embodiment will be described below.

The third exemplary embodiment differs mainly from the first exemplary embodiment also in the control performed by the control section 162Y. Therefore, the following explanation will also focus on the control performed by the control section 162Y.

In the third exemplary embodiment, not the environmental change but a change in adhesion amount of the metallic soap is sensed to switch the voltage to be applied. When the adhesion amount of the metallic soap is changed, friction intensity is also changed between the photoreceptor roller 11Y and the cleaning member 17Y, thereby changing a rotating torque of the photoreceptor roller 11Y. To realize stable image formation, a driving current of a driving section that rotates the photoreceptor roller is controlled to steadily rotate the photoreceptor roller; thereby change in the rotating torque leads to change in the driving current of the driving section 168Y. Therefore, in the third exemplary embodiment, the control section 162Y determines the amount of the metallic soap by sensing the driving current used to rotate the photoreceptor roller 11Y, and switches the voltage to be applied based on the determination.

Figure 6:
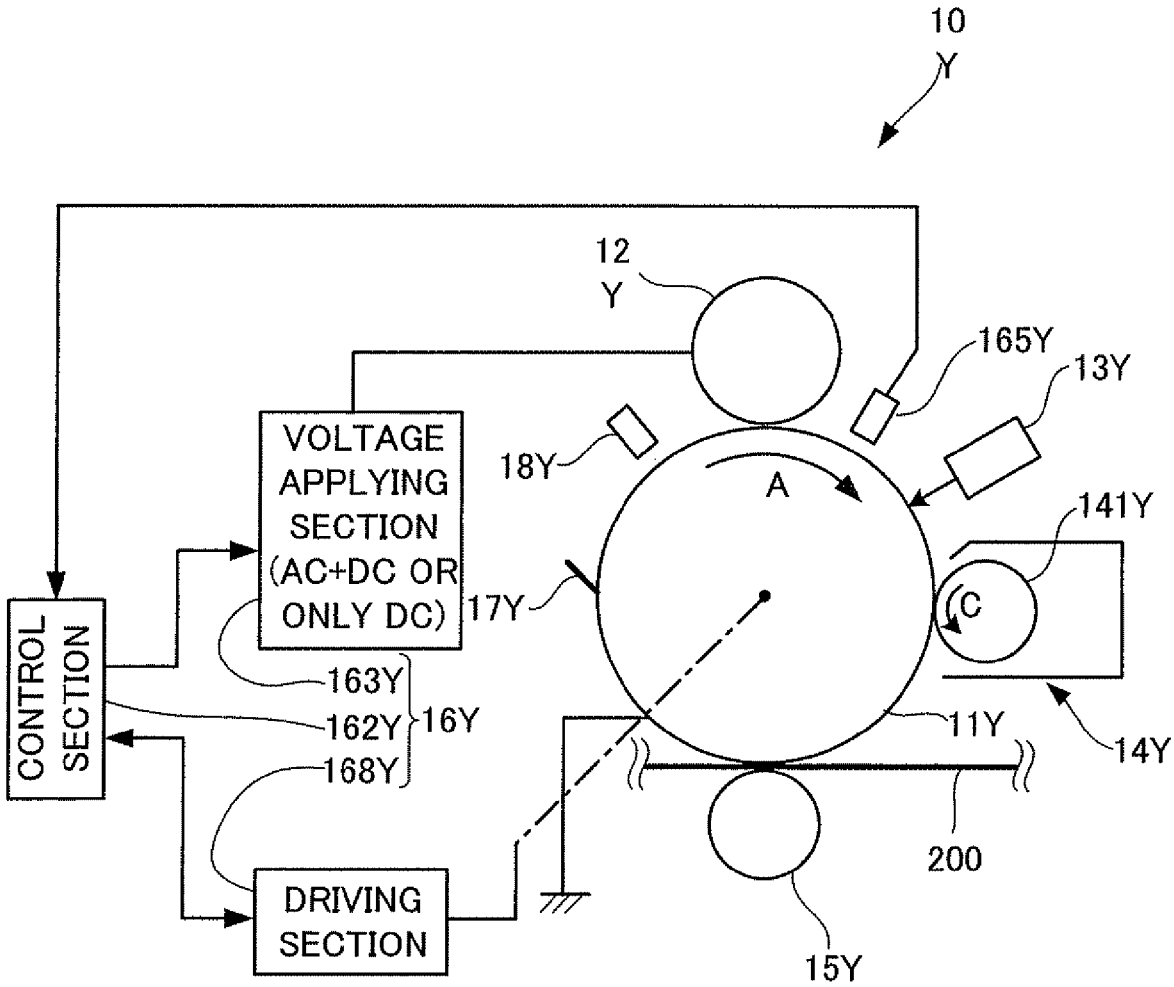
FIG. 6 is a schematic diagram that explains a third exemplary embodiment.
Figure 7:
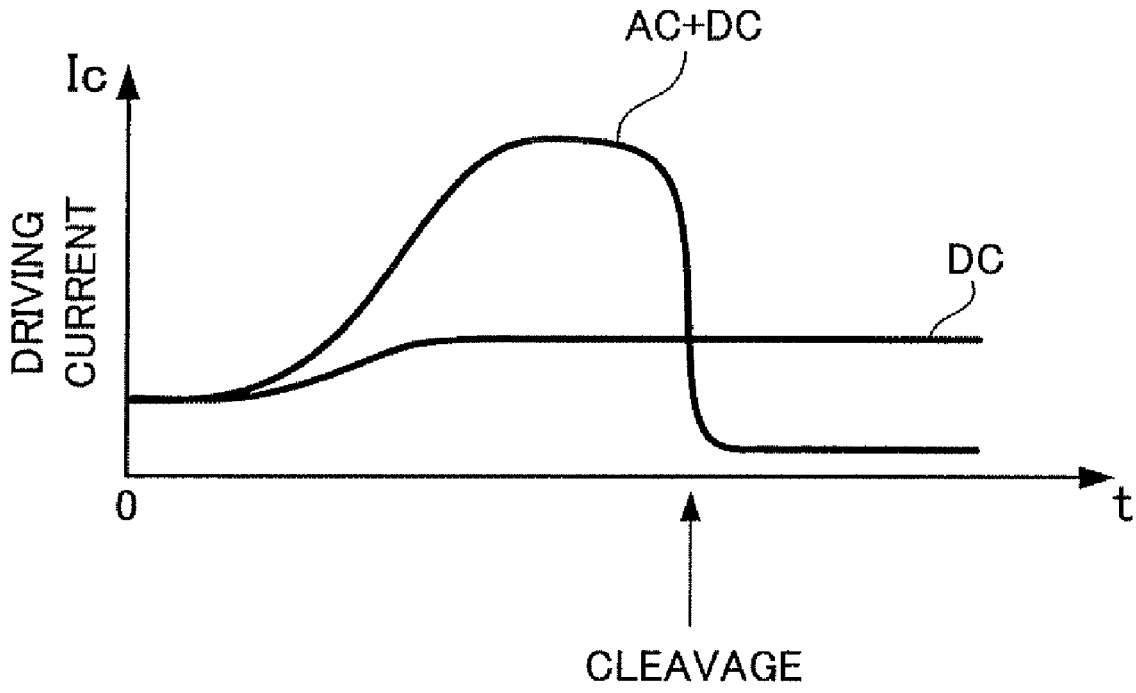
FIG. 7 is a graph illustrating a relationship between the amount of metallic soap and the driving current.

FIGS. 6 and 7 are diagrams explaining the third exemplary embodiment.

FIG. 6 illustrates a driving section 168Y (omitted in FIG. 2) that rotates the photoreceptor roller 11Y. The driving section 168Y includes a motor used to rotate the photoreceptor roller 11Y, and the control section 162Y detects the driving current passing through the motor.

The control section 162Y switches the voltage to be applied from the superimposed voltage to the non-superimposed voltage when the detected driving current is deviated from a predetermined current range. In the third exemplary embodiment, the control section 162Y corresponds to an example of the friction response switching section of the invention as well as an example of the friction sensing section of the invention.

The predetermined current range will be described.

FIG. 7 is a graph illustrating a relationship between the amount of metallic soap and the driving current. In FIG. 7, a horizontal axis indicates time, and a vertical axis indicates the driving current.

In the graph of FIG. 7, when the superimposed voltage is applied, the amount of metallic soap that is of the solid lubricant is increased to thicken the film thickness as time passes, and the toner scraping force is increased, thereby enhancing the driving current. Later, when the amount of the solid lubricant is further increased, a cleavage is eventually generated in the protective film, and the friction intensity is rapidly decreased to reduce the driving current. An arrow of FIG. 7 indicates the time the cleavage is generated.

Because both the high current value (peak value of the graph) immediately before the cleavage and the low current value (right foot of the graph) after the cleavage mean the excessive metallic soap, the voltage to be applied is switched to the non-superimposed voltage to suppress the amount of the metallic soap when the driving current indicates the high current value or the low current value. As illustrated in FIG. 7, in the non-superimposed voltage (DC), the amount of the metallic soap is properly stabilized, and the driving current also becomes a stable value.

That is, the predetermined current range is set between the high current value and the low current value so as to include the stable value.

In the exemplary embodiments, the printer is cited as an example of the image forming apparatus of the invention. Alternatively, the image forming apparatus of the invention may be a copying machine or a facsimile.

In the exemplary embodiments, the indirect transfer type image forming apparatus in which the toner image is transferred to the recording sheet through the transfer belt is cited as an example of the image forming apparatus of the invention. Alternatively, the image forming apparatus of the invention may be a direct transfer type image forming apparatus in which the toner image is directly transferred to the recording sheet using the transfer roller or the like.

Here, the toner will be described. A volume average particle diameter of the toner may range from about 2 to about 10 μm, more preferably, from about 3 to about 8 μm, and still more preferably from about 5 to about 7 μm. It is desirable if the toner has narrow grain size distribution. More specifically, GSDp expressed by the following equation may be 1.25 or less, more preferably 1.22 or less:

$$\mathrm{GSD}p=\{(D84p)/(D16p)\}^{0.5}$$

GSDp is a square root of a ratio of 16% diameter (abbreviated as D16p) and 84% diameter (D84p), in which the number-particle diameters of the toner are converted in the ascending order. It is desirable when both the volume average particle diameter and GSDp fall within the ranges, since effect of the solid lubricant of the invention is hardly prevented.

A shape factor SF1 of the toner may range from about 110 to about 140, and more preferably from about 120 to about 140. As is well known, the spherical toner is easily transferred in the transfer process of the electrophotographic process, and the irregular toner is easily cleaned in the cleaning process. It is desirable when the shape factor SF1 falls within a range described in the invention, since the transfer and cleaning are properly performed, thereby the toner hardly remains on the photoreceptor surface, so that the effect of the solid lubricant of the invention is hardly prevented.

There is no particular limitation to a toner producing method to make the volume average particle diameter, GSDp and shape factor fall within the ranges. For example, the toner may also be obtained by increasing the number of times of a toner classification process using the emulsion polymerization aggregation, suspension polymerization, or mixing crushing which are general chemical production methods and then by changing the shape with hot air or the like.

There is no particular limitation to the solid lubricant added in the toner. The so-called metal soap that is of a metal salt of higher fatty acid may be used as the solid lubricant, and specifically, the zinc stearate is used preferably as the solid lubricant in the invention.

Examples of materials contained in the toner include a binding resin, a coloring agent, a parting agent, a charging control agent, and an external additive. The carrier may be used as the developer. There is no limitation to the materials contained in the toner. For example, materials described in U.S. Pat. No. 7,303,846 may be used.

In the end, examples corresponding to each of the exemplary embodiments will be described.

An example 1 corresponding to the first exemplary embodiment and a comparative example 1 to be compared with the example 1 will be described below.

Example 1

A charging device in a black image forming engine of APEOSPORT C655I (product of Fuji Xerox Co., Ltd.) is changed from a corotron to a charging roller, and an external supply member (rod-like zinc stearate and supply brush) of zinc stearate is detached, thereby forming an experimental machine having the structure of FIG. 2. The real machine running is performed for the total of 40000 A4-sheets using the experimental machine having the structure of FIG. 2. In the real machine running, 30000 A4-sheets are outputted in the H/H environment (28° C. and 85%), and then 10000 A4-sheets are outputted in the L/L environment (10° C. and 15%).

A halftone image having a dot area percentage of 30% for each of the CMYK colors is used as an image pattern on the A4 sheet. The non-image forming region having a width of 3 cm is formed in an end portion of the photoreceptor. The image is periodically formed with the maximum sheet size during the real machine running, and image quality is confirmed.

A developer in which 0.2-weight-percent zinc stearate powder having an average particle diameter of 3 μm is added in the toner is used. The urethane-rubber cleaning member having the thickness of 2 mm is used, and the cleaning member is placed with a free length of 7.5 mm, an abutting angle of 23°, and a bite amount of 1.0 mm.

A temperature and humidity sensor is incorporated in the experimental machine prior to the modification, and the voltage to be applied to the charging roller is switched based on temperature information and humidity information, which are supplied from the temperature and humidity sensor. As to the switching control of the voltage to be applied, as described above, the charging is performed by the non-superimposed voltage in the high-temperature and high-humidity environment, and by the superimposed voltage having the AC component of 1.6 kHz in other environments. The AC is maintained constant at a current value of 2.1 mA.

The image deletion is not generated in the image formation of the maximum sheet size until the 40000 A4-sheets are outputted. When the film thickness of the photoreceptor roller after the real machine running is ended, the difference in film thickness between the image forming region and the non-image forming region is suppressed to 1 μm or less.

Comparative Example 1

For the purpose of comparison with the example 1, the superimposed voltage is applied in all the temperature and humidity environments under the same condition as the real machine running of the example 1. In particularly, the H/H environment is changed to the L/L environment after the test is performed in the H/H environment, and the image is formed with the maximum sheet size using the same halftone image. As a result, it is confirmed that an image quality defect in which the image density is increased in the region corresponding to the non-image forming region is generated.

When the film thickness in the image forming region and non-image forming region of the photoreceptor are measured, the remaining film thickness in the non-image forming region is more than the remaining film thickness in the image forming region by 2.5 μm. Accordingly, the density difference is attributed to the difference in remaining film thickness of the photoreceptor.

An example 2 corresponding to the second exemplary embodiment will be described below.

Example 2

The charging device in the image forming engine of APEOSPORT C655I (product of Fuji Xerox Co., Ltd.) is changed from the corotron to the charging roller, and an external supply member (rod-like zinc stearate and supply brush) of zinc stearate is detached, thereby forming an experimental machine having the structure of FIG. 5. The real machine running is performed for the total of 40000 A4-sheets using the experimental machine having the structure of FIG. 5. In the real machine running, 30000 A4-sheets are outputted in the H/H environment (28° C. and 85%), and then 10000 A4-sheets are outputted in the L/L environment (10° C. and 15%).

The halftone image having the dot percentage of 30% for each of the CMYK colors is used as the image pattern on the A4 sheet. The non-image forming region having the width of 3 cm is formed in the end portion of the photoreceptor. The image is periodically formed with the maximum sheet size during the real machine running, and the image quality is confirmed.

The developer in which the 0.2-weight-percent zinc stearate powder having the average particle diameter of 3 μm is added in the toner is used. The urethane-rubber cleaning member having the thickness of 2 mm is used, and the cleaning member is placed with the free length of 7.5 mm, the abutting angle of 23°, and the bite amount of 1.0 mm.

In the experimental machine of the example 2, the control is performed to sense an output value of the AC voltage to be applied to the charging roller, and a value of the non-superimposed voltage applied to the charging roller is determined from the output voltage to be applied to the charging roller like the first exemplary embodiment. As to the control for switching the superimposed voltage and non-superimposed voltage which are applied to the charging roller, the voltage difference between the peak and the valley (peak-to-peak) of the AC voltage to be applied to the charging roller is sensed by using the AC component of the superimposed voltage (constant current control with a frequency of 1.6 kHz and a constant current of 2.1 mA) during a setup cycle or in-machine control. The non-superimposed voltage is applied when the voltage difference is equal to or lower than a predetermined value (1.6 kV), and the superimposed voltage is applied when the voltage difference is more than the predetermined value. In the H/H environment, the charging is performed by applying the non-superimposed voltage at the beginning of the running. When the image quality is confirmed by using the maximum sheet size, the image quality is maintained normally without generating image deletion until 30000 A4-sheets are outputted.

When the film thickness of the photoreceptor is measured after the real machine running of 30000 A4-sheets, good result is obtained such that the difference in remaining film thickness between the image forming region and the non-image forming region is as small as 1 μm or less.

Then, when the H/H environment is switched to the L/L environment to perform the real machine running of 10000 A4-sheets, an abnormal noise of the blade, an image quality defect of the halftone, and streaky dirt on the charging roller surface caused by a blade crack are not generated. This is attributed to the following fact, that is, the charging is performed by the non-superimposed voltage in the H/H environment to prevent the excessive amount of zinc stearate from adhering to the photoreceptor surface, and the increase in torque necessary to rotate the photoreceptor roller is also suppressed in the L/L environment.

An example 3 corresponding to the third exemplary embodiment will be described below.

Example 3

The charging device in the black image forming engine of APEOSPORT C655I (product of Fuji Xerox Co., Ltd.) is changed from the corotron to the charging roller, and the external supply member (rod-like zinc stearate and supply brush) of zinc stearate is detached, thereby forming an experimental machine having the structure of FIG. 6. The real machine running is performed for the total of 40000 A4-sheets using the experimental machine having the structure of FIG. 6. In the real machine running, 30000 A4-sheets are outputted in the H/H environment (28° C. and 85%), and then 10000 A4-sheets are outputted in the L/L environment (10° C. and 15%).

The halftone image having the dot percentage of 30% for each of the CMYK colors is used as the image pattern on the A4 sheet. The non-image forming region having the width of 3 cm is formed in the end portion of the photoreceptor. The image is periodically formed with the maximum sheet size during the real machine running, and the image quality is confirmed.

The developer in which the 0.2-weight-percent zinc stearate powder having the average particle diameter of 3 μm is added in the toner is used. The urethane-rubber cleaning member having the thickness of 2 mm is used, and the cleaning member is placed with the free length of 7.5 mm, an abutting angle of 23°, and a bite amount of 1.0 mm.

A sensor is incorporated in the experimental machine in order to sense a current output value of the motor that drives the photoreceptor, and the rotating torque state of the motor is sensed by the sensor to make a determination whether the superimposed voltage or the non-superimposed voltage is applied to the charging roller. As to the control for switching voltage to be applied to the photoreceptor roller, the charging is performed by the superimposed voltage since the small amount of metallic soap exists on the photoreceptor layer of the photoreceptor roller when the current output value is equal to or lower than 200 mA (≈estimated load torque of 2 kgf·cm), and the charging is performed by the non-superimposed voltage since the large amount of metallic soap exists on the photoreceptor layer when the current output value is more than 200 mA. When the charging is performed by the superimposed voltage, the AC component of a sine wave with a frequency of 1.6 kHz and a constant current of 2.1 mA is used.

As a result, at the beginning, the charging is performed by the superimposed voltage in the H/H environment, and the superimposed voltage is switched to the non-superimposed voltage when the decrease in torque is sensed after outputting of about 5000 A4-sheets. Then the charging is continuously performed by the non-superimposed voltage until the 30000 A4-sheets are outputted. In forming the halftone image with the maximum sheet size after the running test of about 30000 A4-sheets in the H/H environment, the density difference between the image forming region and the non-image forming region is not generated, and the difference in remaining film thickness between the image forming region and the non-image forming region can be suppressed to about 1 μm or less in the measuring result of the photoreceptor surface film thickness. Then, although the torque is increased up to about 4.1 kgf·cm in the L/L environment, the stable state is obtained, and the friction noise of the cleaning blade is not generated.

Finally, an example 4 corresponding to the third exemplary embodiment and a comparative example 2 to be compared with the example 4 will be described below.

Example 4

The charging device in the black image forming engine of APEOSPORT C 55I (product of Fuji Xerox Co., Ltd.) is changed from the corotron to the charging roller, and an external supply member (rod-like zinc stearate and supply brush) of zinc stearate is detached, thereby forming an experimental machine having the structure of FIG. 6. The real machine running is performed for the total of 50000 A4-sheets using the experimental machine having the structure of FIG. 6. In the real machine running, 30000 A4-sheets are outputted in the H/H environment (28° C. and 85%), and then 20000 A4-sheets are outputted in the L/L environment (10° C. and 15%).

The halftone image having the dot percentage of 30% for each of the CMYK colors is used as the image pattern on the A4 sheet. The non-image forming region having the width of 3 cm is formed in the end portion of the photoreceptor. The image is periodically formed with the maximum sheet size during the real machine running, and the image quality is confirmed.

The developer in which the 0.2-weight-percent zinc stearate powder having an average particle diameter of 3 μm is added in the toner is used. The urethane-rubber cleaning member having the thickness of 2 mm is used, and the cleaning member is placed with the free length of 9.5 mm, the abutting angle of 27°, and a bite amount of 1.0 mm.

A sensor is incorporated in the experimental machine in order to sense the current output value of the motor that drives the photoreceptor, and the rotating torque state of the motor is sensed by the sensor to make a determination whether the superimposed voltage or the non-superimposed voltage is applied to the charging roller. As to the voltage switching control, the charging is performed by the non-superimposed voltage when the current output value is equal to or lower than 200 mA (≈estimated load torque of 2 kgf·cm) and when the current output value is more than 500 mA (≈load torque of 5 kgf·cm), and the charging is performed by the superimposed voltage when the current output value ranges from 200 to 500 mA. The AC component of the superimposed voltage is maintained at the current value of 2.1 mA.

At the beginning, the charging is performed by the superimposed voltage in the H/H environment, and the superimposed voltage is switched to the non-superimposed voltage when the 5000 A4-sheets are outputted. This is because zinc stearate adheres excessively to the photoreceptor surface to generate the cleavage due to the output of 5000 A4-sheets in which the charging is performed by the superimposed voltage, and the rotating torque of the photoreceptor is decreased to lower the driving current of the motor to about 150 mA. The driving current of the motor is maintained at about 150 mA after the superimposed voltage is switched to the non-superimposed voltage, and the non-superimposed voltage is applied until the output of 30000 A4-sheets is completed. Because the charging performed by the non-superimposed voltage is smaller than the charging performed by the superimposed voltage in a discharge stress, an increase in friction coefficient indicating the friction between the photoreceptor and the cleaning blade is originally small, and the excessive state of zinc stearate is hardly generated in the non-image forming region on the photoreceptor surface. Therefore, the stable state is obtained near the load torque of 1.5 kgf·cm. Further, the excessive state of zinc stearate is not generated, and the charging performed by the non-superimposed voltage is smaller than the charging performed by the superimposed voltage in an abrasion rate. Therefore, the difference in abrasion between the image forming region and the non-image forming region becomes small. As a result, the running test ends without generating trouble with the image quality, and the difference in remaining film thickness between the image forming region and the non-image forming region can be suppressed to 1 μm or less in the film thickness measuring result of the photoreceptor after the running test. After the 20000 A4-sheets are outputted in the L/L environment, the photoreceptor surface is uniformly contaminated, and the image quality defect caused by the dirt of the photoreceptor surface is not generated.

Comparative Example 2

The charging device in the black image forming engine of APEOSPORT C655I (product of Fuji Xerox Co., Ltd.) is changed from the corotron to the charging roller, and an external supply member (rod-like zinc stearate and supply brush) of zinc stearate is detached, thereby forming an experimental machine having the structure of FIG. 6. The real machine running is performed for the total of 50000 A4-sheets using the experimental machine having the structure of FIG. 6. In the real machine running, 30000 A4-sheets are outputted in the H/H environment (28° C. and 85%), and then 20000 A4-sheets are outputted in the L/L environment (10° C. and 15%).

The halftone image having the dot percentage of 30% for each of the CMYK colors is used as the image pattern on the A4 sheet. The non-image forming region having the width of 3 cm is formed in the end portion of the photoreceptor. The image is periodically formed with the maximum sheet size during the real machine running, and the image quality is confirmed.

The developer in which the 0.2-weight-percent zinc stearate powder having the average particle diameter of 3 μm is added in the toner is used. The superimposed voltage is always applied to perform the running test similar to that of the example 4.

As a result, in the test in the H/H environment, the image deletion is generated in the region corresponding to the non-image forming region. At this point, the difference in film thickness between the image forming region and the non-image forming region is about 2 μm. In this state, when the running test is performed by changing the H/H environment to the L/L environment, the driving current is increased to slightly generate an abnormal noise during the stop time of the rotation of the photoreceptor roller. The abnormal noise is attributed to stick and slip of the cleaning member and the increase in friction intensity between the photoreceptor surface and the cleaning member. After the running test is performed to 20000 A4-sheets in the L/L environment, streaky dirt of the toner component is generated in the charging roller, and the high-density streak in the halftone corresponding to the streaky dirt is generated as the image quality defect on the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing body on which surface a solid lubricant is supplied, the image bearing body forming an image and bearing the image on the surface;

a charging member to which a voltage is applied, the charging member being in contact with the image bearing body to impart a charge to the image bearing body;

a voltage applying section that applies the voltage to the charging member, the voltage applying section being able to switch the voltage between a superimposed voltage on which a DC voltage and an AC voltage are superimposed and a non-superimposed voltage including only the DC voltage;

an image forming section that forms a toner image on the surface of the image bearing body charged by the charging member;

a transfer device that transfers the toner image formed on the surface of the image bearing body to a transferring body;

a cleaning member that comes into contact with the surface of the image bearing body to scrape an unnecessary substance from the surface after the toner image is transferred to the transferring body; and a voltage switching section that switches the voltage to be applied to the charging member by the voltage applying section between the superimposed voltage and the non-superimposed voltage according to an amount of the solid lubricant on the image bearing body.

2. The image forming apparatus according to claim 1, wherein the voltage switching section further comprises:

an environment sensing section that senses an environment on the image bearing body; and an environment response switching section that switches the voltage to be applied from the superimposed voltage to the non-superimposed voltage when the sensing result of the environment sensing section indicates a predetermined environment in which the amount of the solid lubricant is relatively larger than other environments.

3. The image forming apparatus according to claim 1, wherein the voltage switching section further comprises:

a temperature and humidity sensing section that senses temperature and humidity environments of the image bearing body; and a temperature and humidity response switching section that switches the voltage to be applied from the superimposed voltage to the non-superimposed voltage when the sensing result of the environmental sensing section indicates a predetermined high-temperature and high-humidity environment.

4. The image forming apparatus according to claim 1, wherein the voltage switching section further comprises:

a resistance sensing section that senses a resistance of the charging member; and a resistance response switching section that switches the applied voltage from the superimposed voltage to the non-superimposed voltage when the sensing result of the resistance sensing section indicates a predetermined low-resistance state.

5. The image forming apparatus according to claim 1, wherein the voltage switching section further comprises:

an amount sensing section that directly or indirectly senses an amount of the solid lubricant on the image bearing body; and an amount response switching section that switches the voltage to be applied from the superimposed voltage to the non-superimposed voltage when the sensing result of the amount sensing section indicates a predetermined large amount of the solid lubricant.

6. The image forming apparatus according to claim 1, wherein the voltage switching section further comprises:

a friction sensing section that senses friction intensity between the surface of the image bearing body and the cleaning member when the cleaning member scrapes the unnecessary substance; and a friction response switching section that switches the voltage to be applied from the superimposed voltage to the non-superimposed voltage when the sensing result of the friction sensing section is deviated from a predetermined intensity range.

7. The image forming apparatus according to claim 1, wherein the image forming apparatus is a full-color image forming apparatus.

8. The full-color image forming apparatus according to claim 7, wherein the full-color image forming apparatus includes an intermediate transfer belt.

9. The image forming apparatus according to claim 1, wherein the cleaning member includes urethane rubber.

10. The image forming apparatus according to claim 1, wherein the charging member is a charging roller.

11. The image forming apparatus according to claim 1, wherein the solid lubricant is metal soap.

12. The image forming apparatus according to claim 11, wherein the metal soap is zinc stearate.

13. The image forming apparatus according to claim 12, wherein additive amount of the zinc stearate ranges from about 0.1 to about 1 weight percent.

14. The image forming apparatus according to claim 12, wherein a particle diameter of the zinc stearate ranges from about 0.5 to about 5 μm.

15. The image forming apparatus according to claim 1, wherein a volume average particle diameter of the toner ranges from about 2 to about 10 μm.

16. The image forming apparatus according to claim 1, wherein a number-grain-size distribution (GSDp) of the toner is equal to or smaller than about 1.25.

17. The image forming apparatus according to claim 1, wherein a shape factor of the toner ranges from about 110 to about 140.

* * * * *